US010737186B2

(12) United States Patent
Morosini

(10) Patent No.: US 10,737,186 B2
(45) Date of Patent: Aug. 11, 2020

(54) AMUSEMENT RIDE INTERACTIONS

(71) Applicant: IMAGE STUDIO CONSULTING S.r.l., Vicentina VI (IT)

(72) Inventor: Alessio Morosini, Vicentina VI (IT)

(73) Assignee: Image Studio Consulting S.R.L., Vicentina VI (IT)

( * ) Notice: Subject to any disclaimer, the term of this patent is extended or adjusted under 35 U.S.C. 154(b) by 0 days.

(21) Appl. No.: 16/164,767

(22) Filed: Oct. 18, 2018

(65) Prior Publication Data

US 2019/0270024 A1 Sep. 5, 2019

(30) Foreign Application Priority Data

Mar. 1, 2018 (IT) ..... 102018000003194

(51) Int. Cl.

| | |
|---|---|
| ***A63G 31/02*** | (2006.01) |
| ***A63G 31/16*** | (2006.01) |
| ***A63G 9/16*** | (2006.01) |
| ***A63G 31/00*** | (2006.01) |
| ***A63G 9/00*** | (2006.01) |
| ***A63G 3/02*** | (2006.01) |
| ***A63G 7/00*** | (2006.01) |
| ***A63G 1/10*** | (2006.01) |

(52) U.S. Cl.

CPC ..... *A63G 31/02* (2013.01); *A63G 1/10* (2013.01); *A63G 3/02* (2013.01); *A63G 7/00* (2013.01); *A63G 9/00* (2013.01); *A63G 9/16* (2013.01); *A63G 31/007* (2013.01); *A63G 31/16* (2013.01)

(58) Field of Classification Search

CPC ..... A63G 7/00; A63G 31/00; A63G 31/16; B60R 2021/0097

USPC ..... 472/43, 59–61, 130; 104/83, 84

See application file for complete search history.

(56) References Cited

U.S. PATENT DOCUMENTS

2016/0048203 A1* 2/2016 Blum ..... G06F 3/012 104/84

2017/0080349 A1 3/2017 Reveley

FOREIGN PATENT DOCUMENTS

DE 102015100943 A1 7/2016

WO 2017193043 A1 11/2017

OTHER PUBLICATIONS

Italian Office Action dated Nov. 7, 2018, regarding Italian Application No. 102018000003194.

(Continued)

*Primary Examiner* — Kien T Nguyen

(74) *Attorney, Agent, or Firm* — Sidharth Kapoor; Richard J. Brown; Reed Smith LLP

(57) ABSTRACT

In an aspect of the disclosure, a method, a computer-readable medium, and an apparatus are provided. The apparatus may include an operating system of an amusement ride. In certain implementations, the apparatus may receive first information associated with a motion of the amusement ride. The apparatus may determine whether the motion of the amusement ride meets at least one threshold criterion. The apparatus may receive second information indicating at least one of a set of objects or a set of user characteristic upon determining that the motion of the amusement ride meets the at least one threshold criterion. The apparatus may output an amusement ride interaction based at least in part on the at least one of the set of objects or the set of user characteristics indicated by the second information.

36 Claims, 12 Drawing Sheets

(56) References Cited

OTHER PUBLICATIONS

Italian Search Report and Written Opinion dated Oct. 18, 2018, regarding Italian Application No. 102018000003194.

* cited by examiner

330

AMUSEMENT RIDE INTERACTIONS

CROSS-REFERENCE TO RELATED APPLICATION(S)

This application claims the benefit of Italian Application Serial No. 102018000003194, entitled "AMUSEMENT RIDE INTERACTIONS" and filed on Mar. 1, 2018, which is expressly incorporated by reference herein in its entirety.

BACKGROUND

Field

The present disclosure relates generally to communication systems, and more particularly, to one or more amusement ride interaction(s).

Background

Various amusement rides have been created to provide passengers with unique motion and visual experiences, including roller coasters, theme rides, and simulators. Amusement rides typically have the limitation of being a fixed ride experience, with changes to the ride being made only at great expense. As a result, passengers can become familiar with the ride, which limits the excitement of the user experience.

There is a need to improve the user experience of amusement rides in order to increase the variability, and hence, the excitement of the ride.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Amusement rides typically have the limitation of being a fixed ride experience, with changes to the ride being made only at great expense. As a result, passengers can become familiar with the ride, which limits the excitement of the user experience. There is a need to improve the user experience of amusement rides in order to increase the variability, and hence, the excitement of the ride.

The present disclosure provides a solution by outputting one or more amusement ride interactions based at least in part on a set of user characteristics or a motion of the amusement ride. For example, the set of user characteristics may include one or more of a ratio of a number of raised hands to a number of riders in a segment of the amusement ride, an intensity of a vocal output by the riders, or a gesture performed by the riders, just to name a few. Based on the set of user interactions, the amusement ride may output one or more of a water blast, an audio output, a light output, an air output, a change in a height of the amusement ride, a change in a speed of the amusement ride, send information to one or more mobile devices, or output information on a display, just to name a few.

By enabling the amusement ride to change the ride experience based on rider interaction and/or rider reaction, an amusement ride system of the present disclosure may be able to increase the variability, and hence, the excitement of the ride as compared to a ride with a fixed ride experience.

In an aspect of the disclosure, a method, a computer-readable medium, and an apparatus are provided. The apparatus may include an operating system of an amusement ride. In certain implementations, the apparatus may receive first information associated with a motion of the amusement ride. The apparatus may determine whether the motion of the amusement ride meets at least one threshold criterion. The apparatus may receive second information indicating at least one of a set of objects or a set of user characteristic upon determining that the motion of the amusement ride meets the at least one threshold criterion. The apparatus may output an amusement ride interaction based at least in part on the at least one of the set of objects or the set of user characteristics indicated by the second information.

In certain other implementations, the apparatus may receive information associated with one or more of a height of the amusement ride, a velocity of the amusement ride, an acceleration of the amusement ride, or an angle of the amusement ride with respect to an axis. The apparatus may output an amusement ride interaction based at least in part on the at least one of the height of the amusement ride, the velocity of the amusement ride, the acceleration of the amusement ride, or the angle of the amusement ride with respect to the axis To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

Figure 1:
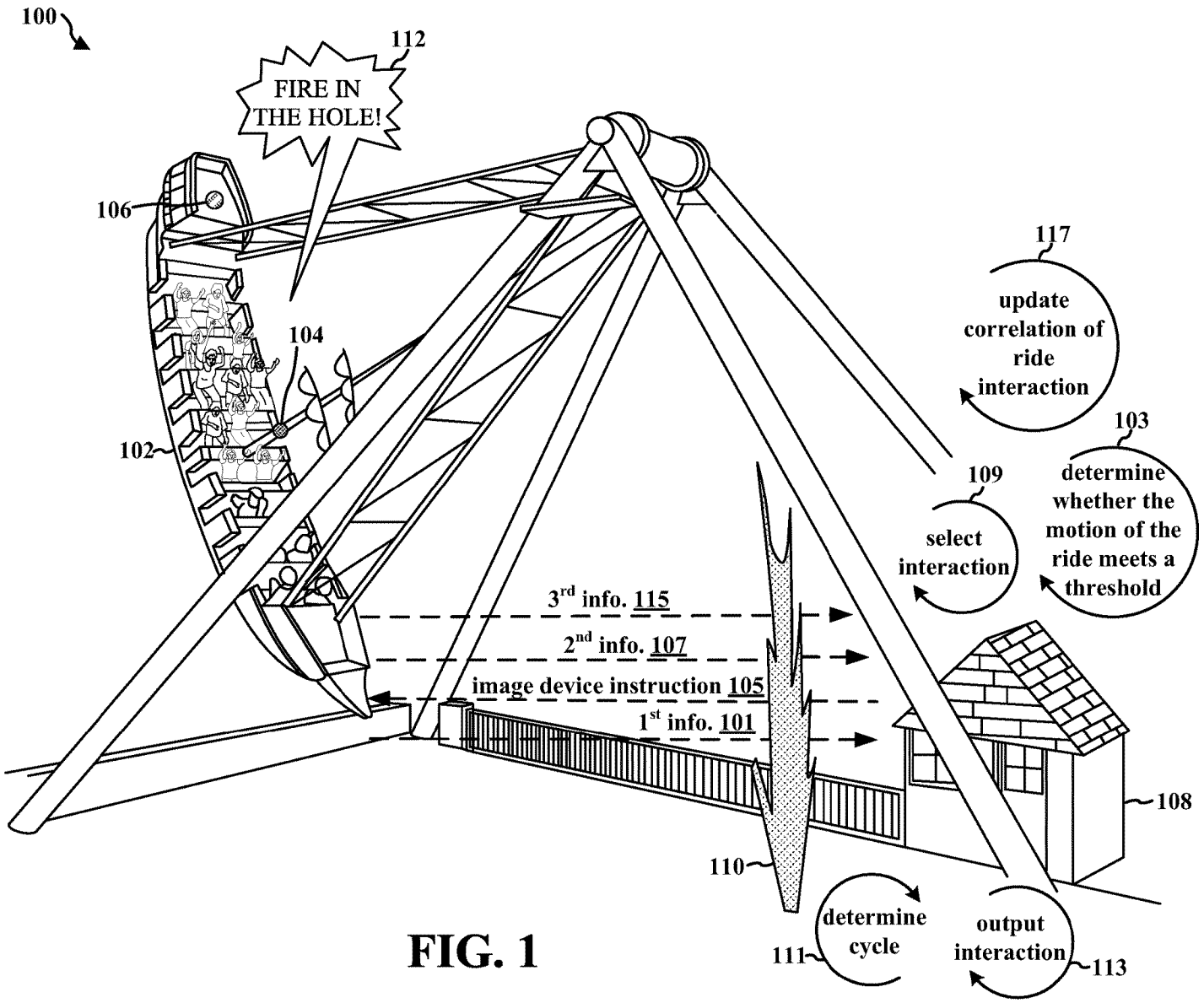
FIG. 1 is a diagram illustrating an example of an amusement ride system in accordance with certain aspects of the disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Several aspects of amusement ride systems will now be presented with reference to various apparatus and methods. These apparatus and methods will be described in the following detailed description and illustrated in the accompanying drawings by various blocks, components, circuits, processes, algorithms, etc. (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented as a "processing system" that includes one or more processors. Examples of processors include microprocessors, microcontrollers, graphics processing units (GPUs), central processing units (CPUs), application processors, digital signal processors (DSPs), reduced instruction set computing (RISC) processors, systems on a chip (SoC), baseband processors, field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software components, applications, software applications, software packages, routines, subroutines, objects, executables, threads of execution, procedures, functions, etc., whether referred to as software, firmware, middleware, microcode, hardware description language, or otherwise.

Accordingly, in one or more example embodiments, the functions described may be implemented in hardware, software, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), optical disk storage, magnetic disk storage, other magnetic storage devices, combinations of the aforementioned types of computer-readable media, or any other medium that can be used to store computer executable code in the form of instructions or data structures that can be accessed by a computer.

Amusement rides typically have the limitation of being a fixed ride experience, with changes to the ride being made only at great expense. As a result, passengers can become familiar with the ride, which limits the excitement of the ride. There is a need to improve the user experience of amusement rides in order to increase the variability, and hence, the excitement of the ride without incurring a great expense to update the ride.

The present disclosure provides a solution by outputting one or more amusement ride interactions based at least in part on a set of user characteristics or a motion of the amusement ride. For example, the set of user characteristics may include one or more of a ratio of a number of raised hands to a number of riders in a segment of the amusement ride, a vocal output by the riders, or a gesture performed by the riders, just to name a few. Based on the set of user interactions, the amusement ride may output one or more of a water blast, at least one audio output, at least one light output, at least one air output, a change in a height of the amusement ride, a change in a speed of the amusement ride, information sent one or more mobile devices, or information output on a display visible from the ride, just to name a few.

By enabling the amusement ride to change the ride experience based on rider interaction and/or rider reaction, an amusement ride system of the present disclosure may be able to increase the variability, and hence, the excitement of the ride as compared to a ride with a fixed ride experience without incurring a great expense to update the ride, e.g., as described below in connection with any of FIGS. 1-9.

FIG. 1 illustrates an amusement ride system 100 in accordance with certain aspects of the disclosure. The example amusement ride system 100 illustrated in FIG. 1 includes an amusement ride 102, at least one image device 104, at least one sensing device 106, an operating system 108, a first amusement ride output device 110, and a second amusement ride output device 112.

For illustrative purposes, the amusement ride 102 in FIG. 1 is illustrated as a galleon ride. However, it should be understood that the amusement ride 102 may include any type of amusement ride without departing from the scope of the present disclosure. For example, the amusement ride 102 may include a roller coaster, a pendulum ride, a Ferris Wheel, a water ride, a virtual reality ride, bumper cars, a drop tower, or a motion ride, just to name a few.

The image device 104 may include any type of device that is configured to capture images. For example, the image device 104 may include a digital camera, a digital video camera, etc. The image device 104 may correspond to, e.g., image device 555. Although the image device 104 illustrated in FIG. 1 is located on the amusement ride 102, the image device 104 may be located remote to the amusement ride 102 so long as the image device 104 is able to capture rider interaction and/or rider reactions.

The sensing device 106 may include any type of device that may be used to determine a relative position of the amusement ride 102. For example, the sensing device 106 may include a gyroscope, an accelerometer, a speedometer, a positioning sensor, a camera, or a proximity sensor, just to name a few. The sensing device 106 may correspond to, e.g., sensing device 550, 850. Although the sensing device 106 illustrated in FIG. 1 is located on the amusement ride 102, the sensing device 106 may be located remote to the amusement ride 102 so long as the sensing device 106 is able to determine a relative position of the amusement ride 102.

The operating system 108 may correspond to, e.g., the operating system 200, the apparatus 502/502', 802/802'. The operating system 108 may be used to receive and process signals from the image device 104 and/or the sensing device 106. Based on the information included in the received signals, the operating system 108 may select one or more amusement ride interactions to be output at the first amusement ride output device 110 and/or the second amusement ride output device 112 to output the selected interaction(s). Although the operating system 108 is illustrated as remote from the amusement ride 102 in FIG. 1, the operating system 108 may be located on the amusement ride 102 without departing from the scope of the present disclosure.

The first amusement ride output device 110 is illustrated as a water output device in FIG. 1. However, the first amusement ride output device 110 may additionally and/or alternatively include one or more of at least one audio output device (e.g., speakers), at least one light output device (e.g., light emitting diodes (LEDs), etc.), at least one air output device (e.g., that emits a blast of air at the riders), a device that changes the height of the amusement ride, a device that changes the speed of the amusement ride, a device that sends signal sent to one or more mobile devices, or an a display device that outputs information visible to the riders during and/or after the ride.

The second amusement ride output device 112 is illustrated as an audio output device in FIG. 1. However, the second amusement ride output device 112 may additionally and/or alternatively include one or more of at least one water output device, at least one light output device (e.g., LEDs, etc.), at least one air output device (e.g., that emits a blast of air at the riders), a device that changes the height of the amusement ride, a device that changes the speed of the amusement ride, a device that sends signal sent to one or more mobile devices, or an a display device that outputs information visible to the riders during and/or after the ride.

The operating system 108 may receive (at 101) first information associated with a motion of the amusement ride 102 from the sensing device 106. In certain implementations, the sensing device 106 may obtain information associated with the motion of the amusement ride 102 periodically (e.g., every 1 millisecond, 10 milliseconds, 0.5 seconds, 1 second, 1.5 seconds, 5 seconds, 10 seconds, etc.), and transmit the first information via a wired or wireless connection to the operating system 108 each time the information is obtained or at predetermined intervals (e.g., 5 seconds, 10 seconds, etc.).

In certain aspects, the first information associated with the motion of the amusement ride 102 may include one or more of a position of the amusement ride 102, a velocity of the amusement ride 102, an acceleration of the amusement ride 102, or an angle of the amusement ride 102 with respect to an axis. In certain implementations, the angle may be a vertical angle and the axis may be a vertical axis. In certain other implementations, the angle may be a horizontal angle and the axis may be a horizontal axis and/or oblique axis.

The operating system 108 may determine (at 103) whether the motion of the amusement ride 102 meets at least one threshold criterion based at least in part on the first information. For example, the threshold criterion may include one or more of a threshold height, a threshold velocity, a threshold acceleration, a threshold angle, an initial motion of the amusement ride 102 (e.g., when the ride starts) or receiving user instructions to initiate the amusement ride interaction. By way of example, the threshold criterion may be an acceleration of 0 meters/second$^2$ (m/s$^2$). That is, when the amusement ride 102 reaches the highest point in the pendulum swing, the operating system 108 may determine (at 103) that the acceleration of the amusement ride 102 meets the threshold criterion since the acceleration of the amusement ride 102 at the highest point in the pendulum swing is 0 m/s$^2$. Otherwise, when the amusement ride 102 is at any point in the pendulum swing other than the highest point, the operating system 108 may determine (at 103) that the acceleration of the amusement ride 102 is 0 m/s$^2$, and hence, does not meet the threshold criterion.

Upon determining (at 103) that the motion of the amusement ride 102 meets the threshold criterion, the operating system 108 may send (at 105) a signal to the image device 104 associated with the amusement ride 102 via a wired or wireless connection. In certain aspects, the signal sent (at 105) by the operating system 108 may instruct the image device 104 to obtain second information indicating at least one of a set of objects (e.g., raised hands, a number of riders, a number of riders in a portion of the amusement ride 102, etc.) or a set of user characteristics (e.g., a ratio of a number of raised hands to a number of riders in a segment of the amusement ride 102, a noise level output by the riders, or a gesture performed by the riders, etc.). Examples the second information that is obtained by the image device 104 are described below in connection with FIGS. 4A and 4B.

The operating system 108 may receive (at 107) the second information indicating the set of objects and/or the set of user characteristics from the image device 104. In certain implementations, the second information may be received via a wired or wireless connection with the image device 104.

Based at least in part on the second information, the operating system 108 may select (at 109) which the amusement ride interaction to output from a plurality of amusement ride interactions (e.g., at least one water output, at least one audio output, at least one light output, at least one air output, a change in a height of the amusement ride, a change in a speed of the amusement ride, a signal sent to one or more mobile devices, or an information output on a display). In certain aspects, the selected amusement ride interaction may be correlated with the set of objects or the set of user characteristics.

For example, the operating system 108 may access one or more look-up table(s) that includes a correlation of the set of objects (e.g., raised hands, a number of riders, a number of riders in a portion of the amusement ride 102, etc.), the set of user characteristics (e.g., a ratio of a number of raised hands to a number of riders in a segment of the amusement ride 102, a noise level output by the riders, or a gesture performed by the riders, etc.), and/or an amusement ride cycle (e.g., a first pendulum swing of twelve total pendulum swings) to one or more amusement ride interactions (e.g., at least one water output, at least one audio output, at least one light output, at least one air output, a change in a height of the amusement ride, a change in a speed of the amusement ride, a signal sent to one or more mobile devices, or an information output on a display). Using the correlation(s) maintained in the look-up table, the operating system 108 may select (at 109) the amusement ride interaction that is correlated with the set of objects and/or the set of user characteristics included in the second information received from the image device 104.

Additionally and/or alternatively, the operating system 108 may determine (at 111) the amusement ride cycle (e.g., the first pendulum swing of twelve pendulum swings) from a plurality of amusement ride cycles (e.g., a set of twelve pendulum swings per ride). The operating system 108 may additionally and/or alternatively select (at 109) the amusement ride interaction based at least in part on the determined amusement ride cycle. For example, the first cycle may be correlated with an audio output and a water blast as illustrated in FIG. 1, the second cycle may be correlated with an air blast and a visual display, the third cycle may be correlated with a variation in the motion of the amusement ride 102, etc.

Based on the amusement ride interaction selected from the look-up table, the operating system 108 may output (at 113) the amusement ride interaction based at least in part on the at least one of the set of objects, the set of user characteristics indicated by the second information, and/or the amusement ride cycle. For example, assuming that the set of objects and/or set of user characteristics in the second information indicates that the riders on the bow made a louder noise and had more hands raised, the operating system 108 may output a water blast at the first amusement ride output device 110 that will soak the riders on the stern of the ship and output audio at the second amusement ride output device 112 directed towards the riders at the stern of the ship.

Alternatively, the operating system 108 may output (at 113) the amusement ride interaction based on a height of the amusement ride, a velocity of the amusement ride, an acceleration of the amusement ride, or an angle of the amusement ride with respect to an axis. For example, the operating system 108 may access one or more look-up table(s) that includes a correlation of the motion (e.g., height, acceleration, velocity, vertical angle with respect to a vertical axis, horizontal angle with respect to a horizontal axis, etc.) of the amusement ride 102 to one or more amusement ride interactions (e.g., at least one water output, at least one audio output, at least one light output, at least one air output, a change in a height of the amusement ride, a change in a speed of the amusement ride, a signal sent to one or more mobile devices, or an information output on a display), and output the amusement ride interaction correlated with the motion of the amusement ride 102.

While the amusement ride interaction is being output (at 113), the image device 104 may obtain third information associated with the riders' reaction to the amusement ride interaction that is transmitted (at 115) to the operating system 108 via a wired or wireless connection. For example, the third information may indicate one or more of the riders' reactions at the stern and/or bow to the amusement ride interaction. The rider's reactions may include one or more of a facial expression, a gesture, or a vocal sound. The operating system 108 may determine whether or not the riders enjoyed the amusement ride interaction and rate the level of enjoyment based on various factors (e.g., the number of riders cheering, the intensity of sound made by the riders, etc.).

Using the third information, the operating system 108 may update (at 117) a correlation between the at least one of the set of objects or the set of user characteristics and the amusement ride interaction maintained in the look-up table based at least in part on the third information. For example, when the third information indicates that the riders did not react to the amusement ride interaction, the operating system 108 may change the amusement ride interaction correlated with the set of objects and/or set of user characteristics indicated in the second information since the riders did not seem to find the amusement ride interaction exciting.

Using the technique(s) described above in connection with FIG. 1, an amusement ride system 100 of the present disclosure may be able to increase the variability, and hence, the excitement of the ride as compared to a ride with a fixed ride experience without incurring a great expense to update the ride by updating and changing the amusement ride interactions.

Figure 2:
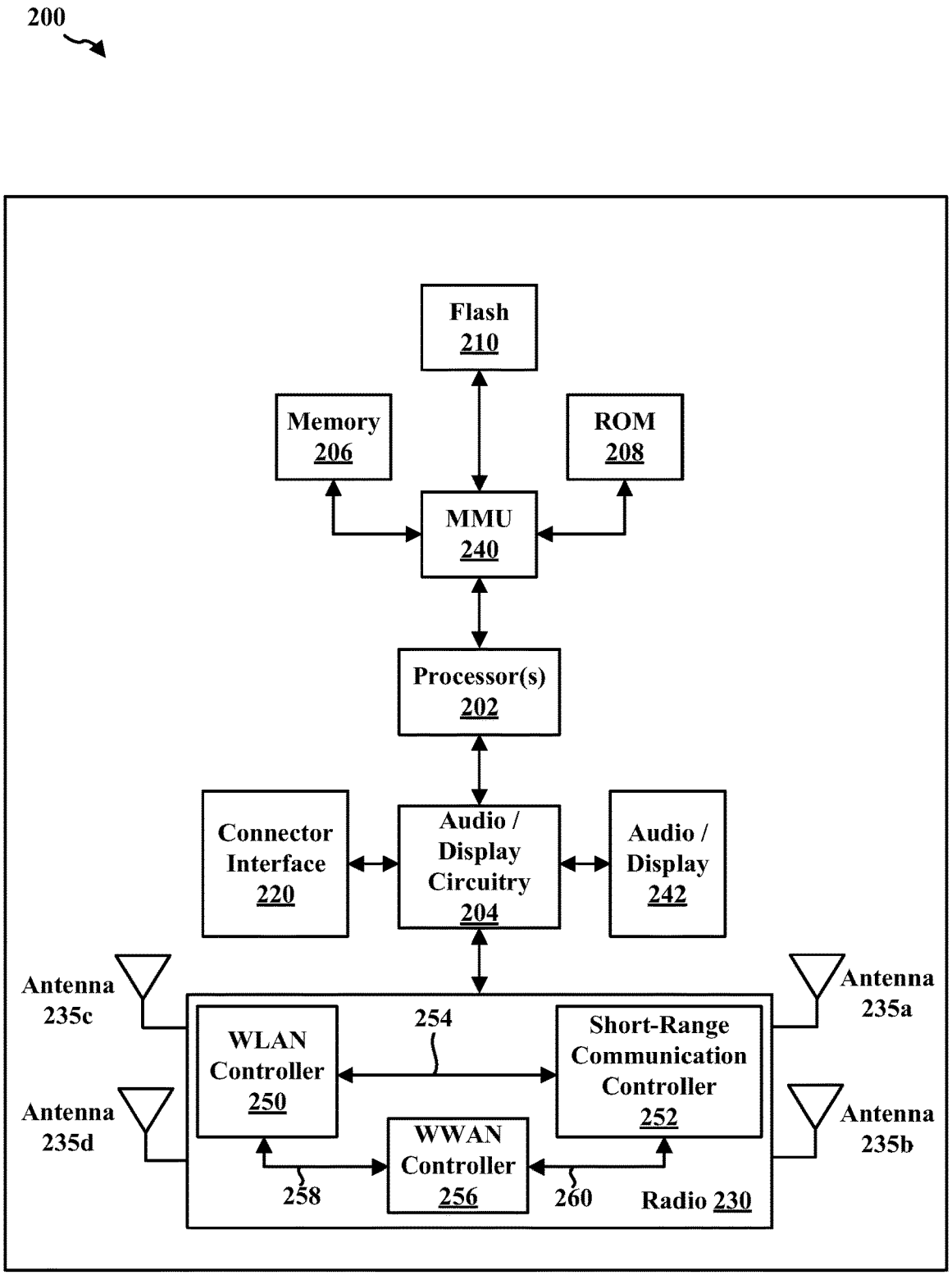
FIG. 2 is block diagram of an operating system for an amusement ride in accordance with certain aspects of the disclosure.

FIG. 2 is block diagram of an operating system 200 in accordance with certain aspects of the disclosure. The operating system 200 may correspond to, e.g., the operating system 108, the apparatus 502/502', 802/802'. In certain aspects, the operating system 200 may be associated with an amusement ride system.

As shown in FIG. 2, the operating system 200 may include a processing element, such as processor(s) 202, which may execute program instructions for the operating system 200. The operating system 200 may also include audio/display circuitry 204 which may perform audio processing and/or graphics processing and provide audio signals, audio packets, and/or display signals to the audio/display 242 (e.g., speakers, display screen, etc.). The processor(s) 202 may also be coupled to a memory management unit (MMU) 240, which may be configured to receive addresses from the processor(s) 202 and translate the addresses to address locations in memory (e.g., memory 206, ROM 208, Flash memory 210) and/or to address locations in other circuits or devices, such as the audio/display circuitry 204, radio 230, connector interface 220, and/or audio/display 242. The MMU 240 may be configured to perform memory protection and page table translation or set up. In some embodiments, the MMU 240 may be included as a portion of the processor(s) 202. In certain configurations, one or more of the processor(s) 202, memory 206, ROM 208, and/or Flash memory 210 may be configured to access one or more look-up table(s) that includes a correlation of one or more of a set of objects (e.g., raised hands, a number of riders, a number of riders in a portion of the amusement ride, etc.), a set of user characteristics (e.g., a ratio of a number of raised hands to a number of riders in a segment of the amusement ride, a noise level output by the riders, or a gesture performed by the riders, etc.), and/or an amusement ride cycle (e.g., a first pendulum swing of twelve total pendulum swings) to one or more amusement ride interactions (e.g., at least one water output, at least one audio output, at least one light output, at least one air output, a change in a height of the amusement ride, a change in a speed of the amusement ride, a signal sent to one or more mobile devices, or an information output on a display).

As shown, the processor(s) 202 may be coupled to various other circuits of the operating system 200. For example, the operating system 200 may include various types of memory 206, a connector interface 220 (e.g., for coupling to the computer system), the audio/display 242, and wireless communication circuitry (e.g., for Wi-Fi, Bluetooth Bluetooth Low Energy®, cellular, etc.) for communicating with a sensing device, an image device, an amusement ride, an amusement ride output device, etc. The operating system 200 may include a plurality of antennas 235*a*, 235*b*, 235*c*, 235*d*, for performing wireless communication with, e.g., a sensing device, an image device, an amusement ride, an amusement ride output device, etc.

In certain aspects, the operating system 200 may include hardware and software components (a processing element) configured to select one or more amusement ride interactions based at least in part on the set of objects, user characteristics, and/or the amusement ride cycle, e.g., using the techniques described in connection with any of FIGS. 1 and 3A-9.

The operating system 200 may be configured to implement part or all of the techniques described below in connection with any of FIGS. 1 and 3A-9, e.g., by executing program instructions stored on a memory medium (e.g., a non-transitory computer-readable memory medium) and/or through hardware or firmware operation. In other embodiments, the techniques described below in connection with any of FIGS. 1 and 3A-9 may be at least partially implemented by a programmable hardware element, such as an field programmable gate array (FPGA), and/or an application specific integrated circuit (ASIC).

In certain aspects, radio 230 may include separate controllers configured to control communications for various respective radio access technology (RAT) protocols. For example, as shown in FIG. 2, radio 230 may include a wireless local area network (WLAN) controller 250 configured to control WLAN communications, a short-range communication controller 252 configured to control short-range communications, and a wireless wide area network (WWAN) controller 256 configured to control WWAN communications. In certain aspects, the operating system 200 may store and execute a WLAN software driver for controlling WLAN operations performed by the WLAN controller 250, a short-range communication software driver for controlling short-range communication operations performed by the short-range communication controller 252, and/or a WWAN software driver for controlling WWAN operations performed by the WWAN controller 256.

In some aspects, one or more of the WLAN controller 250, the short-range communication controller 252, and/or the WWAN controller 256 may be implemented as hardware, software, firmware or some combination thereof.

Figure 3A:
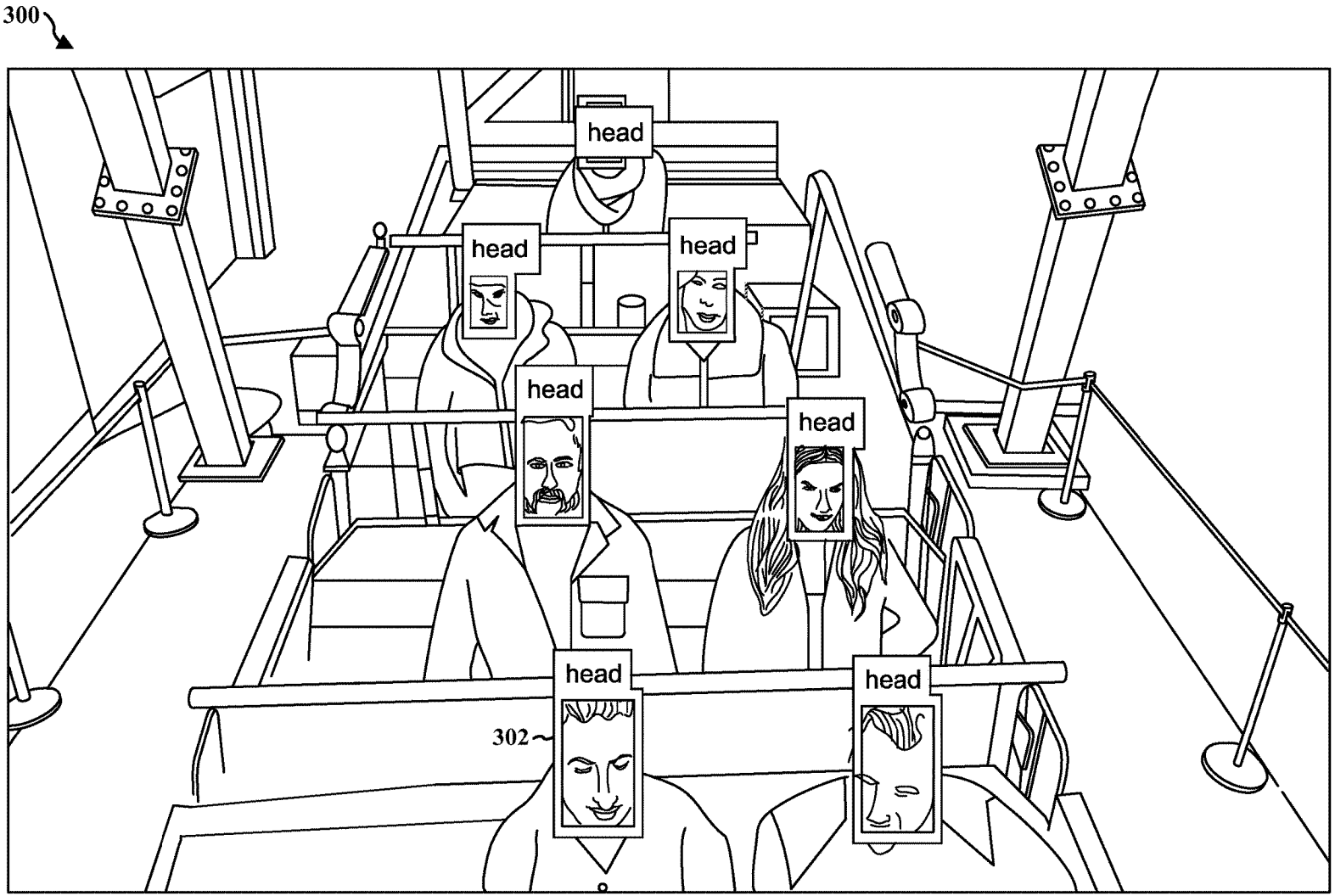
FIG. 3A is a diagram illustrating the detection of the number of riders in accordance with certain aspects of the disclosure.

FIG. 3A is a diagram 300 illustrating the detection of the number of riders in accordance with certain aspects of the disclosure. For example, the image device 104 described above in connection with FIG. 1 may capture an image (e.g., the second information) of the number of riders at the stern of the galleon amusement ride 102. The operating system 108 may determine the number of riders by detecting the riders' heads 302 and/or faces. In certain implementations, the operating system 108 may perform head recognition and/or facial recognition to identify features of the head and/or face by extracting landmarks, or features, from known landmarks or features of a head and/or face.

Figure 3B:
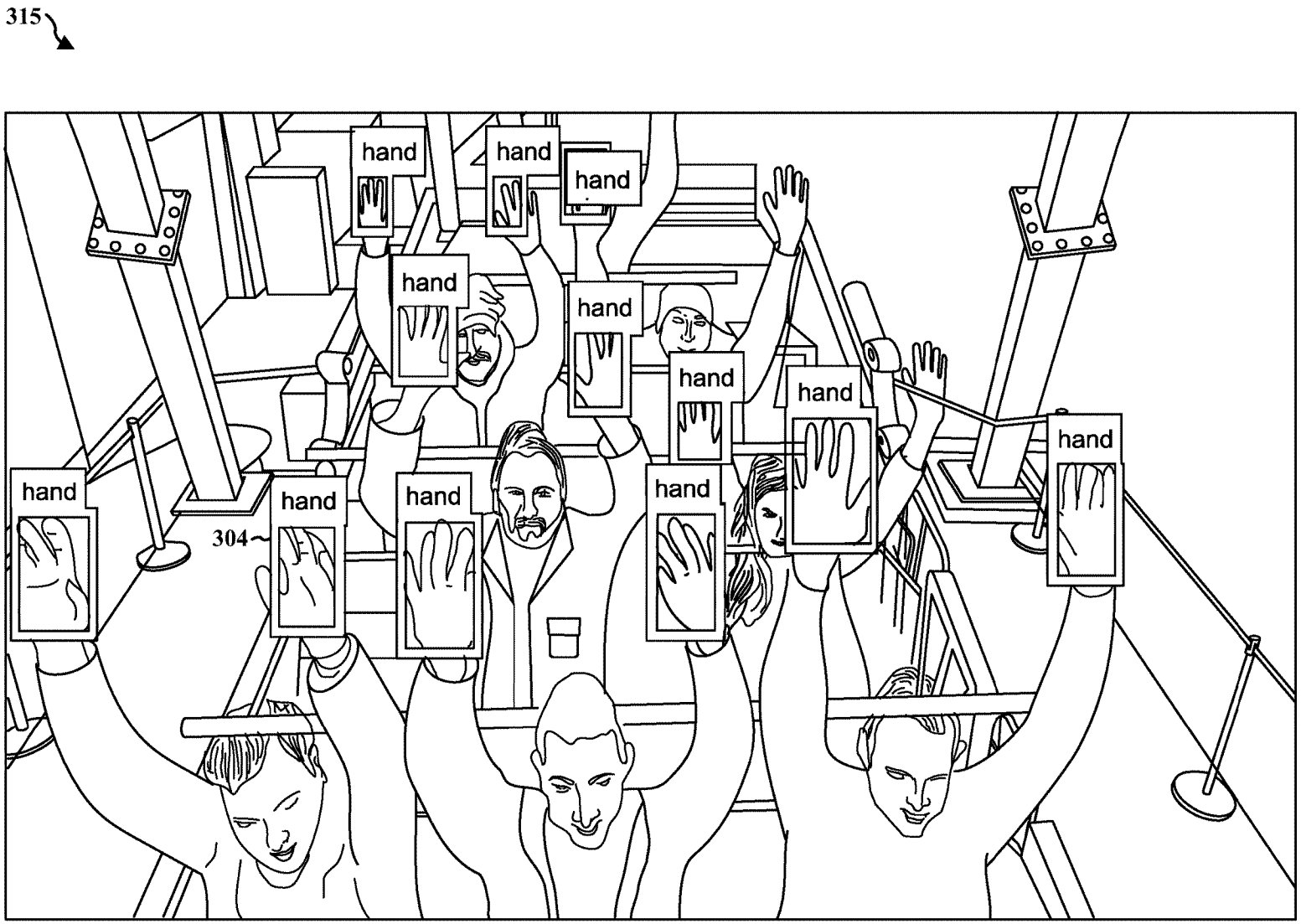
FIG. 3B is a diagram illustrating the detection of a set of objects and/or rider characteristics in accordance with certain aspects of the disclosure.

FIG. 3B is a diagram 315 illustrating the detection of objects and/or rider characteristics in accordance with certain aspects of the disclosure. For example, the image device 104 described above in connection with FIG. 1 may capture an image (e.g., the second information) of the riders at the stern of the galleon amusement ride 102. The operating system 108 may determine the set of objects and/or set of user characteristics by determining the number raised rider hands 304. In certain implementations, the operating system 108 may perform object and/or characteristic recognition to identify the number of hands by extracting landmarks, or features, from known landmarks or features of a hand. In certain other implementations, the operating system 108 may perform object and/or characteristic recognition for body language recognition, facial expression recognition, voice recognition may be used as input for the second information instead of or in addition to hands count.

Figure 3C:
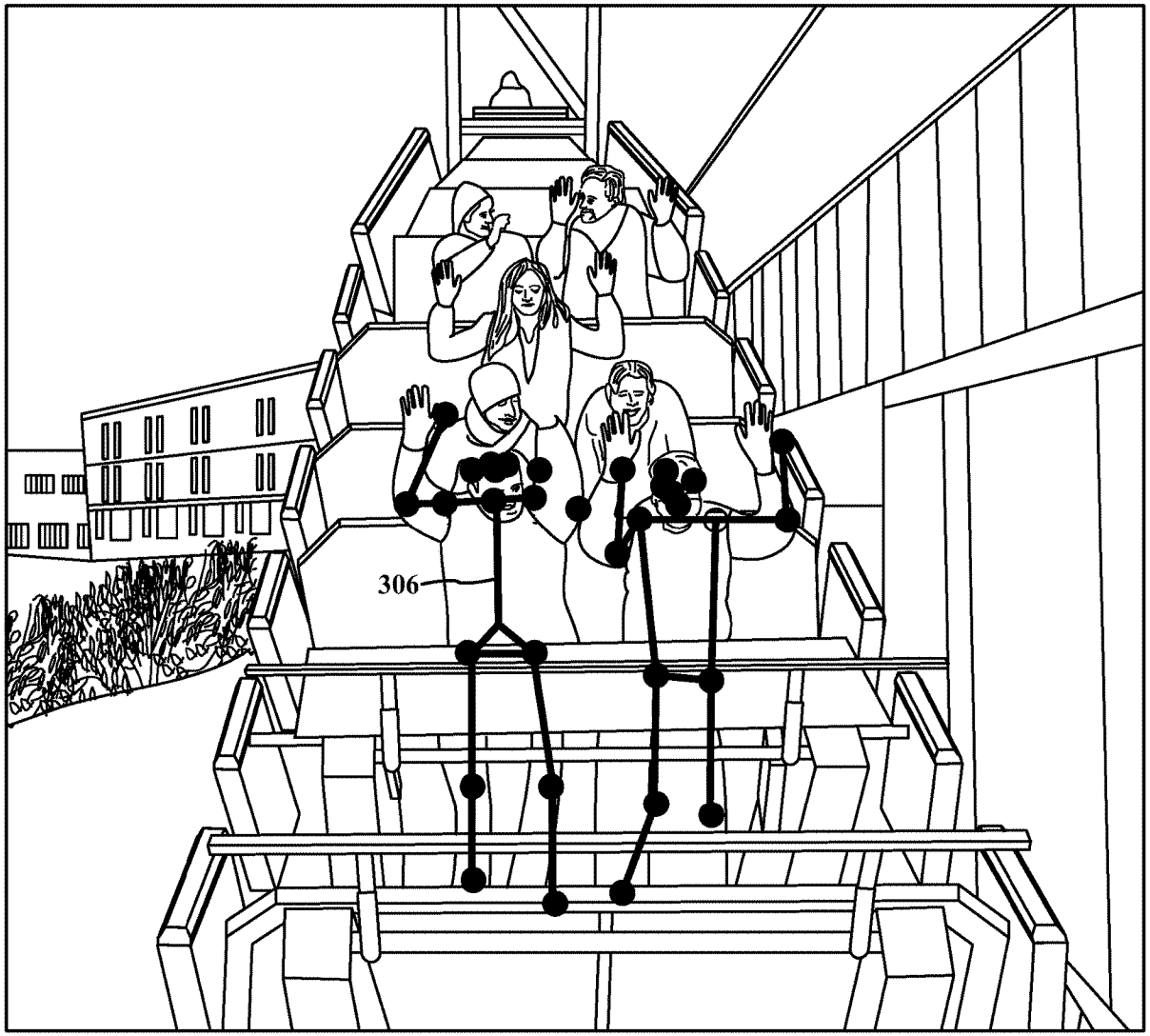
FIG. 3C is a diagram illustrating the detection of a rider reaction in accordance with certain aspects of the disclosure.

FIG. 3C is a diagram 330 illustrating the detection of a rider reaction in accordance with certain aspects of the disclosure. For example, the image device 104 described above in connection with FIG. 1 may capture an image (e.g., the second information) of the riders at the stern of the galleon amusement ride 102. The operating system 108 may determine the riders' reactions by detecting the body language 306 and/or body position 306. In certain implementations, the operating system 108 may perform body language, facial expression recognition, recognition to identify the riders' reactions by extracting landmarks, features, movements, and/or positions from known landmarks of body or a face, features of a body or face, movements of a body or face, and/or positions of a body or face.

Figure 4A:
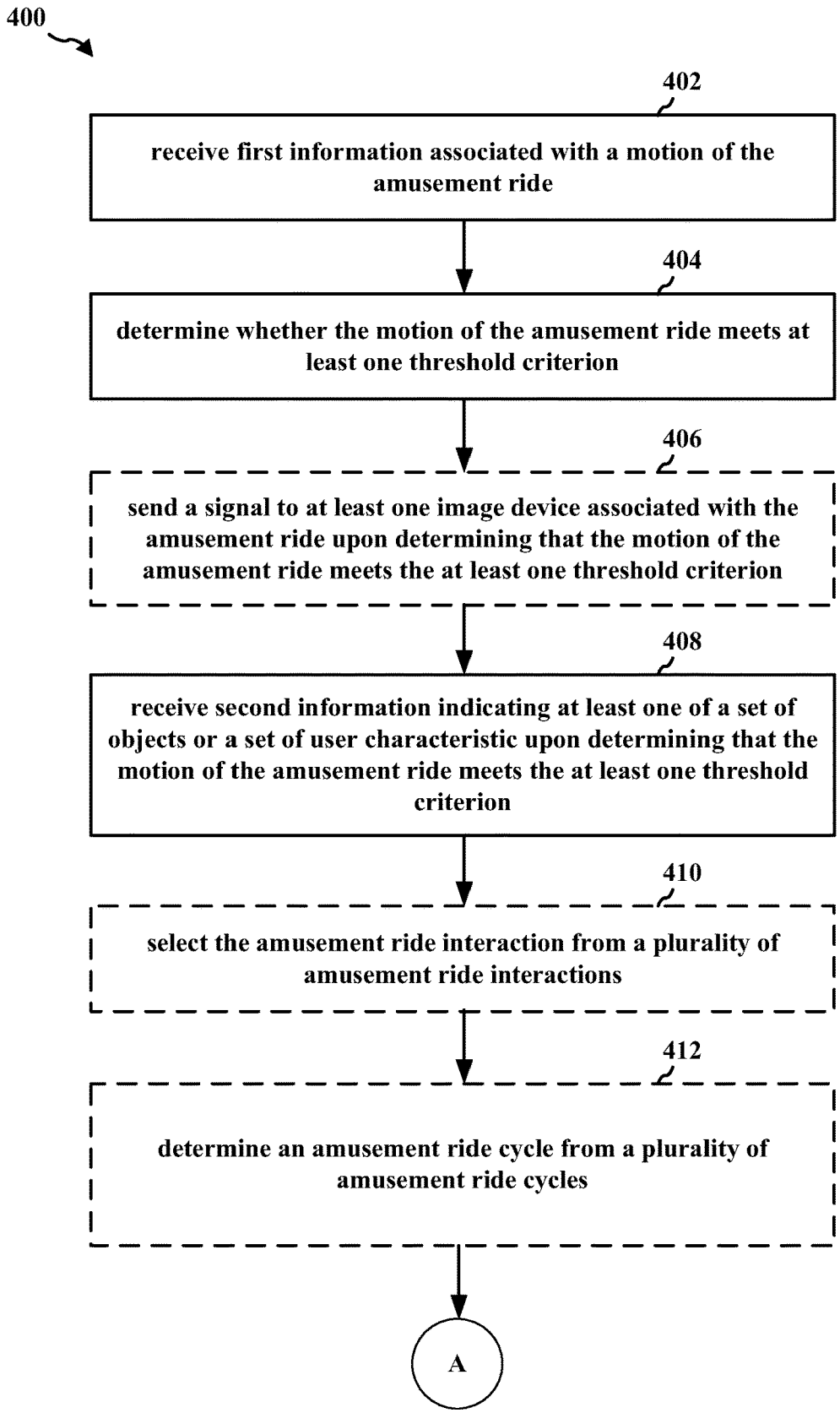
FIGS. 4A and 4B are flowcharts of a method of operating an amusement ride.
Figure 4B:
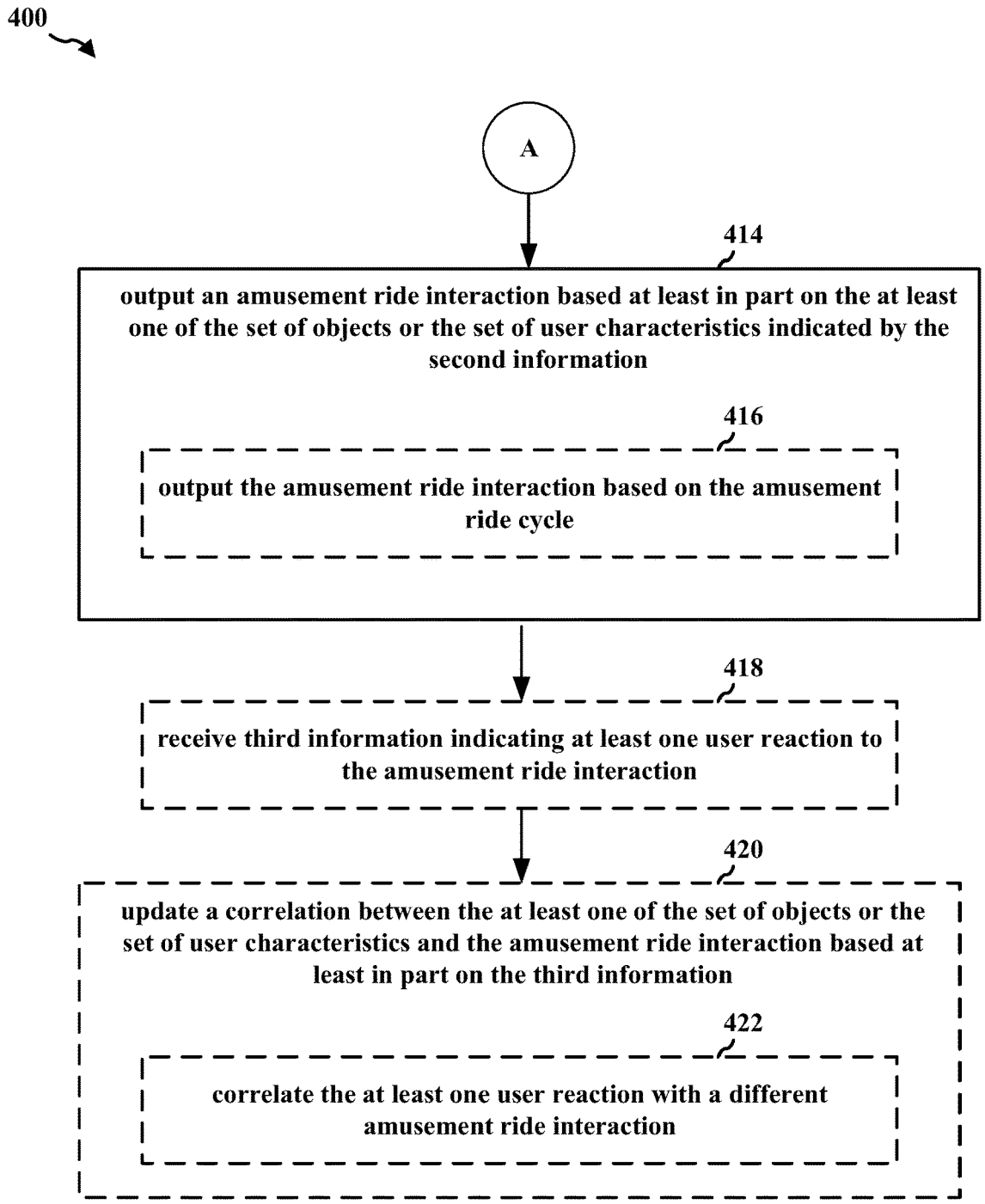

FIGS. 4A and 4B are a flowchart 400 of a method of operating an amusement ride. The method may be performed by an operating system (e.g., operating system 108, 200, the apparatus 502/502', 802/802'). In FIGS. 4A and 4B, optional operations are indicated with dashed lines.

Referring to FIG. 4A, at 402, the operating system may receive first information associated with a motion of the amusement ride. In certain aspects, the motion of the amusement ride may include one or more of a position of the amusement ride, a velocity of the amusement ride, an acceleration of the amusement ride, or an angle of the amusement ride with respect to an axis. In certain other aspects, the first information may be received from at least one of a gyroscope, an accelerometer, a speedometer, a positioning sensor, a camera, or a proximity sensor. For example, referring to FIG. 1, the operating system 108 may receive (at 101) first information associated with a motion of the amusement ride 102 from the sensing device 106. In certain implementations, the sensing device 106 may obtain information associated with the motion of the amusement ride 102 periodically (e.g., every 1 millisecond, 10 milliseconds, 0.5 seconds, 1 second, 1.5 seconds, 5 seconds, 10 seconds, etc.), and transmit the first information via a wired or wireless connection to the operating system 108 each time the information is obtained or at predetermined intervals (e.g., 5 seconds, 10 seconds, etc.).

At 404, the operating system may determine whether the motion of the amusement ride meets at least one threshold criterion. In certain aspects, the at least one threshold criterion may include one or more of a threshold height, a threshold velocity, a threshold acceleration, or a threshold angle. For example, referring to FIG. 1, the operating system 108 may determine (at 103) whether the motion of the amusement ride 102 meets at least one threshold criterion based at least in part on the first information. For example, the threshold criterion may include one or more of a threshold height, a threshold velocity, a threshold acceleration, or a threshold angle. By way of example, the threshold criterion may be an acceleration of 0 meters/second$^2$ (m/s$^2$). That is, when the amusement ride 102 reaches the highest point in the pendulum swing, the operating system 108 may determine (at 103) that the acceleration of the amusement ride 102 meets the threshold criterion since the acceleration of the amusement ride 102 at the highest point in the pendulum swing is 0 m/s$^2$. Otherwise, when the amusement ride 102 is at any point in the pendulum swing other than the highest point, the operating system 108 may determine (at 103) that the acceleration of the amusement ride 102 is $\neq 0$ m/s$^2$, and hence, does not meet the threshold criterion.

At 406, the operating system may send a signal to at least one image device associated with the amusement ride upon determining that the motion of the amusement ride meets the at least one threshold criterion. In certain aspects, the signal may instruct the at least one image device to obtain the second information. In certain other aspects, the at least one threshold criterion may include an initial motion of the amusement ride or receiving user instructions to initiate the amusement ride interaction (e.g., before the ride starts). For example, referring to FIG. 1, upon determining (at 103) that the motion of the amusement ride 102 meets the threshold criterion, the operating system 108 may send (at 105) a signal to the image device 104 associated with the amusement ride 102 via a wired or wireless connection. In certain aspects, the signal sent (at 105) by the operating system 108 may instruct the image device 104 to obtain second information indicating at least one of a set of objects (e.g., raised hands, a number of riders, a number of riders in a portion of the amusement ride 102, etc.) or a set of user characteristics (e.g., a ratio of a number of raised hands to a number of riders in a segment of the amusement ride 102, a noise level output by the riders, or a gesture performed by the riders, etc.). Examples the second information that is obtained by the image device 104 are described above in connection with FIGS. 4A-4C.

At 408, the operating system may receive second information indicating at least one of a set of objects or a set of user characteristic upon determining that the motion of the amusement ride meets the at least one threshold criterion. In certain aspects, the set of user characteristics may include one or more of a ratio of a number of raised hands to a number of riders in a segment of the amusement ride, a vocal output by the riders, or a gesture performed by the riders. For example, referring to FIG. 1, the operating system 108 may receive (at 107) the second information indicating the set of objects and/or the set of user characteristics from the image device 104. In certain implementations, the second information may be received via a wired or wireless connection with the image device 104.

At 410, the operating system may select the amusement ride interaction from a plurality of amusement ride interactions. In certain aspects, the selected amusement ride interaction may be correlated with the set of objects or the set of user characteristics. In certain other aspects, the amusement ride interaction may include one or more of at least one water output, at least one audio output, at least one light output, at least one air output, a change in a height of the amusement ride, a change in a speed of the amusement ride, a signal sent to one or more mobile devices, or an information output on a display. For example, referring to FIG. 1, based at least in part on the second information, the operating system 108 may select (at 109) which the amusement ride interaction to output from a plurality of amusement ride interactions (e.g., at least one water output, at least one audio output, at least one light output, at least one air output, a change in a height of the amusement ride, a change in a speed of the amusement ride, a signal sent to one or more mobile devices, or an information output on a display). In certain aspects, the selected amusement ride interaction may be correlated with the set of objects or the set of user characteristics. For example, the operating system 108 may access one or more look-up table(s) that includes a correlation of the set of objects (e.g., raised hands, a number of riders, a number of riders in a portion of the amusement ride 102, etc.), the set of user characteristics (e.g., a ratio of a number of raised hands to a number of riders in a segment of the amusement ride 102, a noise level output by the riders, or a gesture performed by the riders, etc.), and/or an amusement ride cycle (e.g., a first pendulum swing of twelve total pendulum swings) to one or more amusement ride interactions (e.g., at least one water output, at least one audio output, at least one light output, at least one air output, a change in a height of the amusement ride, a change in a speed of the amusement ride, a signal sent to one or more mobile devices, or an information output on a display). Using the correlation(s) maintained in the look-up table, the operating system 108 may select (at 109) the amusement ride interaction that is correlated with the set of objects and/or the set of user characteristics included in the second information received from the image device 104.

At 412, the operating system may determine an amusement ride cycle from a plurality of amusement ride cycles. For example, referring to FIG. 1, the operating system 108 may determine (at 111) the amusement ride cycle (e.g., the first pendulum swing of twelve pendulum swings) from a plurality of amusement ride cycles (e.g., a set of twelve pendulum swings per ride).

Referring to FIG. 4B, at 414, the operating system may output an amusement ride interaction based at least in part on the at least one of the set of objects or the set of user characteristics indicated by the second information. For example, referring to FIG. 1, based on the amusement ride interaction selected from the look-up table, the operating system 108 may output (at 113) the amusement ride interaction based at least in part on the at least one of the set of objects or the set of user characteristics indicated by the second information. For example, assuming that the set of objects and/or set of user characteristics in the second information indicates that the riders on the bow made a louder noise and had more hands raised, the operating system 108 may output a water blast at the first amusement ride output device 110 that will soak the riders on the stern of the ship and output audio at the second amusement ride output device 112 directed towards the riders at the stern of the ship.

At 416, the operating system may output the amusement ride interaction based at least in part on the at least one of the set of objects or the set of user characteristics indicated by the second information by outputting the amusement ride interaction based on the amusement ride cycle. For example, referring to FIG. 1, the operating system 108 may additionally and/or alternatively output (at 113) the amusement ride interaction based at least in part on the determined amusement ride cycle. For example, the first cycle may be correlated with an audio output and a water blast as illustrated in FIG. 1, the second cycle may be correlated with an air blast and a visual display, the third cycle may be correlated with a variation in the motion of the amusement ride 102, etc.

At 418, the operating system may receive third information indicating at least one user reaction to the amusement ride interaction. In certain aspects, the at least one user reaction may include one or more of a facial expression, a gesture, or a vocal sound. For example, referring to FIG. 1, while the amusement ride interaction is being output (at 113), the image device 104 may obtain third information associated with the riders' reaction to the amusement ride interaction that is transmitted (at 115) to the operating system 108 via a wired or wireless connection. For example, the third information may indicate one or more of the riders' reactions at the stern and/or bow to the amusement ride interaction. The rider's reactions may include one or more of a facial expression, a gesture, or a vocal sound. The operating system 108 may determine whether or not the riders enjoyed the amusement ride interaction and rate the level of enjoyment based on various factors (e.g., the number of riders cheering, the intensity of sound made by the riders, etc.).

At 420, the operating system may update a correlation between the at least one of the set of objects or the set of user characteristics and the amusement ride interaction based at least in part on the third information. For example, referring to FIG. 1, using the third information, the operating system 108 may update (at 117) a correlation between the at least one of the set of objects or the set of user characteristics and the amusement ride interaction maintained in the look-up table based at least in part on the third information.

At 422, the operating system may update a correlation between the at least one of the set of objects or the set of user characteristics and the amusement ride interaction based at least in part on the third information by correlating the at least one user reaction with a different amusement ride interaction. For example, referring to FIG. 1, when the third information indicates that the riders did not react to the amusement ride interaction, the operating system 108 may change the amusement ride interaction correlated with the set of objects and/or set of user characteristics indicated in the second information since the riders did not seem to find the amusement ride interaction exciting.

Figure 5:
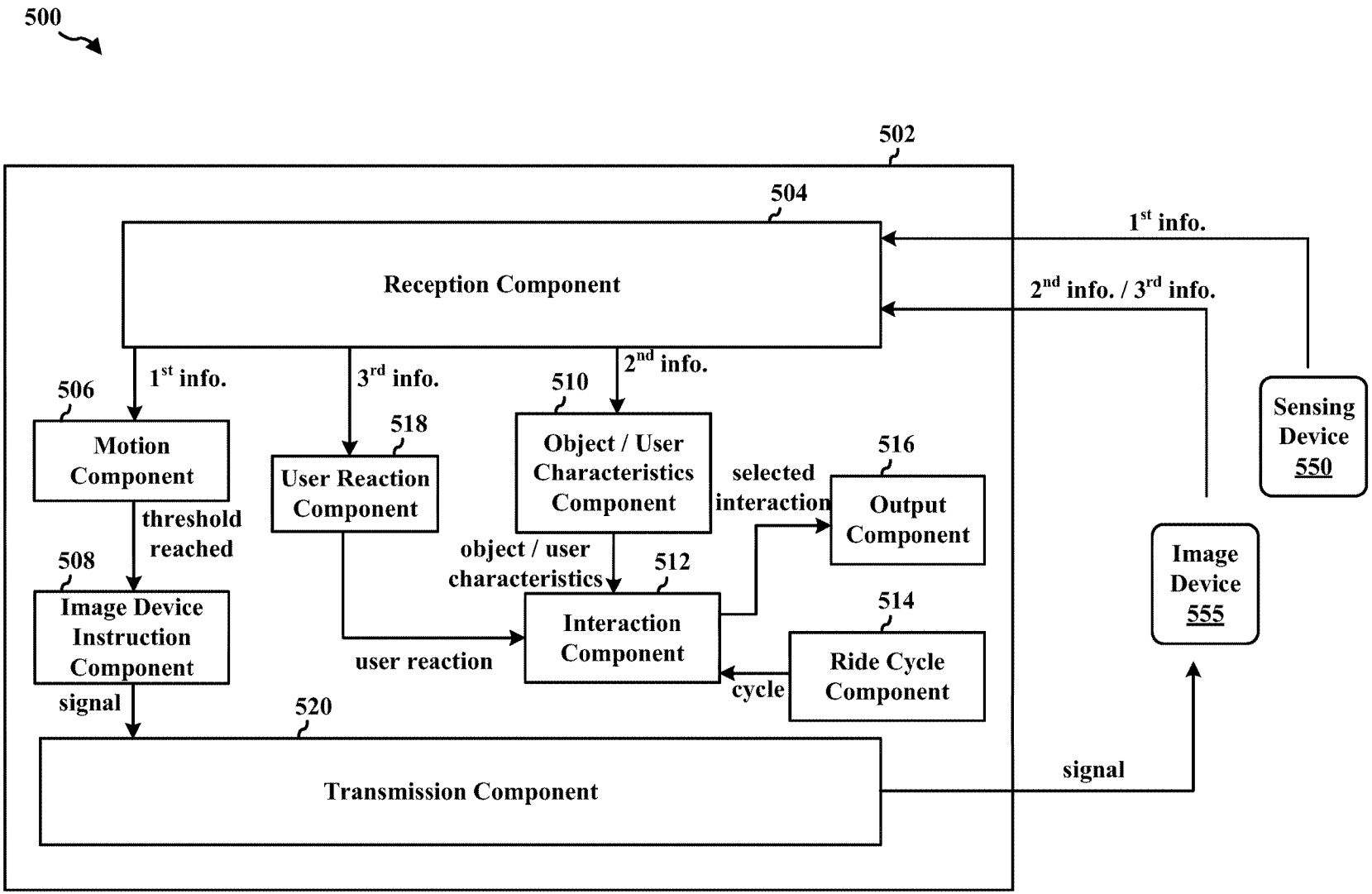
FIG. 5 is a conceptual data flow diagram illustrating the data flow between different means/components in an exemplary apparatus.

FIG. 5 is a conceptual data flow diagram 500 illustrating the data flow between different means/components in an exemplary apparatus 502. The apparatus may be an operating system (e.g., operating system 108, 200, the apparatus 502', 802/802') in communication with at least one sensing device 550 (e.g., the sensing device 106, 850) and at least one image device 555 (e.g., the image device 104). The apparatus may include a reception component 504, a motion component 506, an image device instruction component 508, an object/user characteristics component 510, an interaction component 512, a ride cycle component 514, an output component 516, and a transmission component 520.

The reception component 504 may be configured to receive first information associated with a motion of the amusement ride from the sensing device 550. In certain aspects, the motion of the amusement ride may include one or more of a position of the amusement ride, a velocity of the amusement ride, an acceleration of the amusement ride, or an angle of the amusement ride with respect to an axis. In certain other aspects, the first information may be received from at least one of a gyroscope, an accelerometer, a speedometer, a positioning sensor, a camera, or a proximity sensor. The reception component 504 may be configured to send the first information to the motion component 506.

The motion component 506 may be configured to determine whether the motion of the amusement ride meets at least one threshold criterion. In certain aspects, the at least one threshold criterion may include one or more of a threshold height, a threshold velocity, a threshold acceleration, or a threshold angle. Upon determining that the motion of the amusement ride meets the at least one threshold criterion, the motion component 506 may be configured to send a signal indicated the threshold criterion has been met to the image device instruction component 508.

The image device instruction component 508 may be configured to generate a signal that instructs the at least one image device to obtain second information. The image device instruction component 508 may be configured to send the signal to the transmission component 520.

The transmission component 520 may be configured to send the signal to the at least one image device 555 associated with the amusement ride upon determining that the motion of the amusement ride meets the at least one threshold criterion.

The reception component 504 may be configured to receive second information indicating at least one of a set of objects or a set of user characteristic upon determining that the motion of the amusement ride meets the at least one threshold criterion. In certain aspects, the set of user characteristics may include one or more of a ratio of a number of raised hands to a number of riders in a segment of the amusement ride, a vocal output by the riders, or a gesture performed by the riders. The reception component 504 may be configured to send the second information to the object/user characteristics component 510.

The object/user characteristics component 510 may be configured to determine the set of objects and/or the set of user characteristic based on the second information. The object/user characteristics component 510 may be configured to send a signal associated with the determine set of objects and/or user characteristics to the interaction component 512.

The ride cycle component 514 may be configured to determine an amusement ride cycle from a plurality of amusement ride cycles. The ride cycle component 514 may be configured to send a signal associated with the ride cycle to the interaction component 512.

The interaction component 512 may be configured to select the amusement ride interaction from a plurality of amusement ride interactions. In certain aspects, the selected amusement ride interaction may be correlated with the set of objects, the set of user characteristics, and/or the ride cycle. In certain other aspects, the amusement ride interaction may include one or more of at least one water output, at least one audio output, at least one light output, at least one air output, a change in a height of the amusement ride, a change in a speed of the amusement ride, a signal sent to one or more mobile devices, or an information output on a display. The interaction component 512 may be configured to send a signal associated with the selected amusement ride interaction to the output component 516.

The output component 516 may be configured to output an amusement ride interaction based at least in part on the at least one of the set of objects or the set of user characteristics indicated by the second information. In certain configurations, the output component 516 may be configured to output the amusement ride interaction based at least in part on the at least one of the set of objects or the set of user characteristics indicated by the second information by outputting the amusement ride interaction based on the amusement ride cycle.

The reception component 504 may be configured to receive third information indicating at least one user reaction to the amusement ride interaction from the image device 555. In certain aspects, the at least one user reaction may include one or more of a facial expression, a gesture, or a vocal sound. The reception component 504 may be configured to send the third information to the user reaction component 518. The user reaction component 518 may be configured to determine the users' reactions based at least in part on the third information. The user reaction component 518 may be configured to send a signal indicating the users' reactions to the interaction component 512.

The interaction component 512 may be configured to update a correlation between the at least one of the set of objects or the set of user characteristics and the amusement ride interaction based at least in part on the third information. In certain configurations, interaction component 512 may be configured to update a correlation between the at least one of the set of objects or the set of user characteristics and the amusement ride interaction based at least in part on the third information by correlating the at least one user reaction with a different amusement ride interaction.

The apparatus may include additional components that perform each of the blocks of the algorithm in the aforementioned flowcharts of FIGS. 4A and 4B. As such, each block in the aforementioned flowcharts of FIGS. 4A and 4B may be performed by a component and the apparatus may include one or more of those components. The components may be one or more hardware components specifically configured to carry out the stated processes/algorithm, implemented by a processor configured to perform the stated processes/algorithm, stored within a computer-readable medium for implementation by a processor, or some combination thereof.

Figure 6:
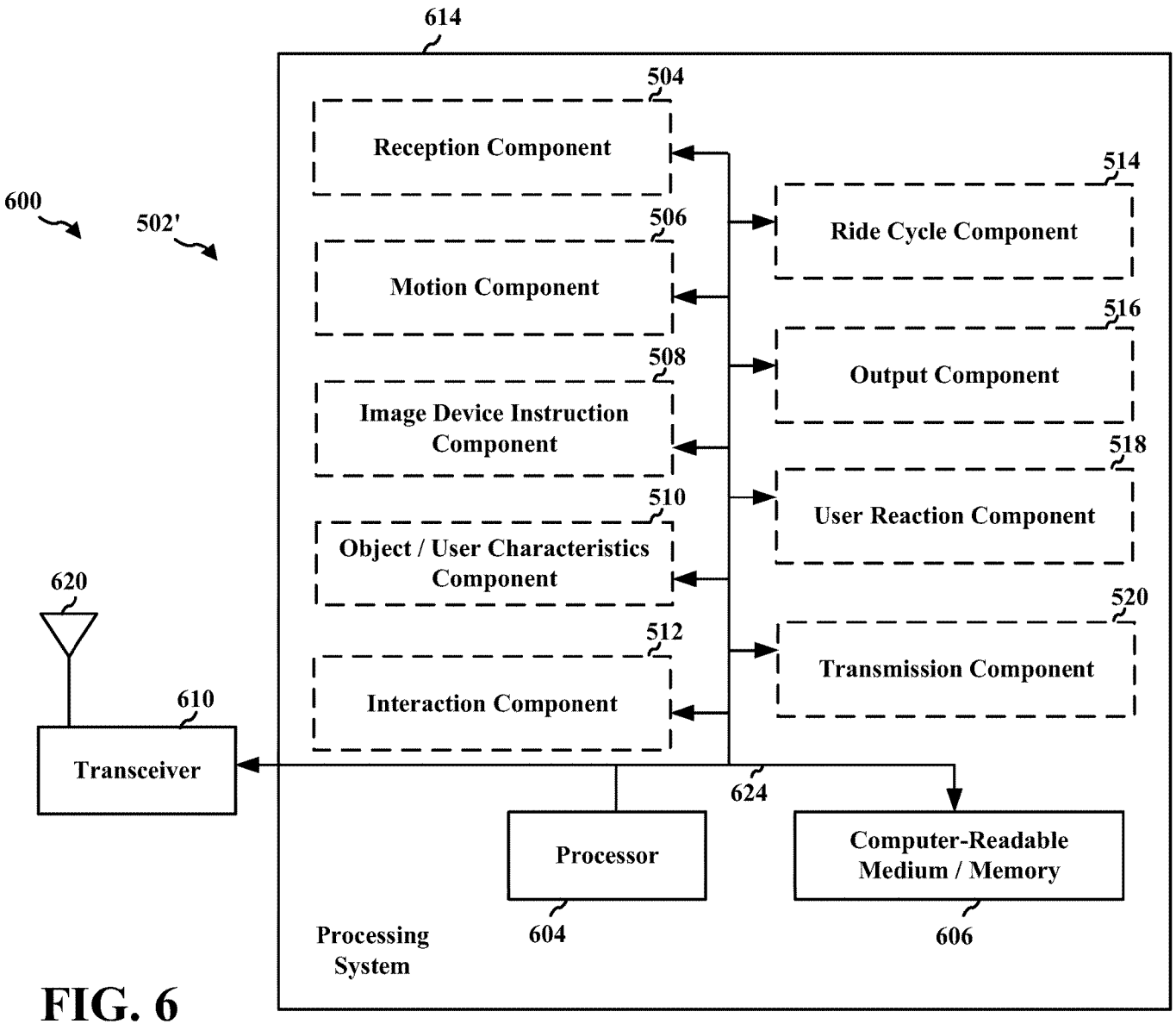
FIG. 6 is a diagram illustrating an example of a hardware implementation for an apparatus employing a processing system.

FIG. 6 is a diagram 600 illustrating an example of a hardware implementation for an apparatus 502' employing a processing system 614. The processing system 614 may be implemented with a bus architecture, represented generally by the bus 624. The bus 624 may include any number of interconnecting buses and bridges depending on the specific application of the processing system 614 and the overall design constraints. The bus 624 links together various circuits including one or more processors and/or hardware components, represented by the processor 604, the components 504, 506, 508, 510, 512, 514, 516, 518, 520, and the computer-readable medium/memory 606. The bus 624 may also link various other circuits such as timing sources, peripherals, voltage regulators, and power management circuits, which are well known in the art, and therefore, will not be described any further.

The processing system 614 may be coupled to a transceiver 610. The transceiver 610 is coupled to one or more antennas 620. The transceiver 610 provides a means for communicating with various other apparatus over a transmission medium. The transceiver 610 receives a signal from the one or more antennas 620, extracts information from the received signal, and provides the extracted information to the processing system 614, specifically the reception component 504. In addition, the transceiver 610 receives information from the processing system 614, specifically the transmission component 520, and based on the received information, generates a signal to be applied to the one or more antennas 620. The processing system 614 includes a processor 604 coupled to a computer-readable medium/memory 606. The processor 604 is responsible for general processing, including the execution of software stored on the computer-readable medium/memory 606. The software, when executed by the processor 604, causes the processing system 614 to perform the various functions described supra for any particular apparatus. The computer-readable medium/memory 606 may also be used for storing data that is manipulated by the processor 604 when executing software. The processing system 614 further includes at least one of the components 504, 506, 508, 510, 512, 514, 516, 518, 520. The components may be software components running in the processor 604, resident/stored in the computer readable medium/memory 606, one or more hardware components coupled to the processor 604, or some combination thereof.

In certain configurations, the apparatus 502/502' for operation of an amusement ride may include means for receiving first information associated with a motion of the amusement ride. In certain aspects, the motion of the amusement ride may include one or more of a position of the amusement ride, a velocity of the amusement ride, an acceleration of the amusement ride, or an angle of the amusement ride with respect to an axis. In certain other aspects, the first information may be received from at least one of a gyroscope, an accelerometer, a speedometer, a positioning sensor, a camera, or a proximity sensor. In certain other configurations, the apparatus 502/502' for operation of an amusement ride may include means for determining whether the motion of the amusement ride meets at least one threshold criterion. In certain aspects, the at least one threshold criterion may include one or more of a threshold height, a threshold velocity, a threshold acceleration, or a threshold angle. In certain other configurations, the apparatus 502/502' for operation of an amusement ride may include means for sending a signal to at least one image device associated with the amusement ride upon determining that the motion of the amusement ride meets the at least one threshold criterion. In certain aspects, the signal may instruct the at least one image device to obtain the second information. In certain other aspects, the at least one threshold criterion may include an initial motion of the amusement ride or receiving user instructions to initiate the amusement ride interaction. In certain other configurations, the apparatus 502/502' for operation of an amusement ride may include means for receiving second information indicating at least one of a set of objects or a set of user characteristic upon determining that the motion of the amusement ride meets the at least one threshold criterion. In certain aspects, the set of user characteristics may include one or more of a ratio of a number of raised hands to a number of riders in a segment of the amusement ride, a vocal output by the riders, or a gesture performed by the riders. In certain other configurations, the apparatus 502/502' for operation of an amusement ride may include means for selecting the amusement ride interaction from a plurality of amusement ride interactions. In certain aspects, the selected amusement ride interaction may be correlated with the set of objects or the set of user characteristics. In certain other aspects, the amusement ride interaction may include one or more of at least one water output, at least one audio output, at least one light output, at least one air output, a change in a height of the amusement ride, a change in a speed of the amusement ride, a signal sent to one or more mobile devices, or an information output on a display. In certain other configurations, the apparatus 502/502' for operation of an amusement ride may include means for determining an amusement ride cycle from a plurality of amusement ride cycles. In certain other configurations, the apparatus 502/502' for operation of an amusement ride may include means for outputting an amusement ride interaction based at least in part on the at least one of the set of objects or the set of user characteristics indicated by the second information. In certain aspects, the means for outputting the amusement ride interaction based at least in part on the at least one of the set of objects or the set of user characteristics indicated by the second information may be configured to output the amusement ride interaction based on the amusement ride cycle. In certain other configurations, the apparatus 502/502' for operation of an amusement ride may include means for receiving third information indicating at least one user reaction to the amusement ride interaction. In certain aspects, the at least one user reaction may include one or more of a facial expression, a gesture, or a vocal sound. In certain other configurations, the apparatus 502/502' for operation of an amusement ride may include means for updating a correlation between the at least one of the set of objects or the set of user characteristics and the amusement ride interaction based at least in part on the third information. In certain aspects, the means for updating the correlation between the at least one of the set of objects or the set of user characteristics and the amusement ride interaction based at least in part on the third information may be configured to correlate the at least one user reaction with a different amusement ride interaction. The aforementioned means may be one or more of the aforementioned components of the apparatus 502 and/or the processing system 614 of the apparatus 502' configured to perform the functions recited by the aforementioned means.

Figure 7:
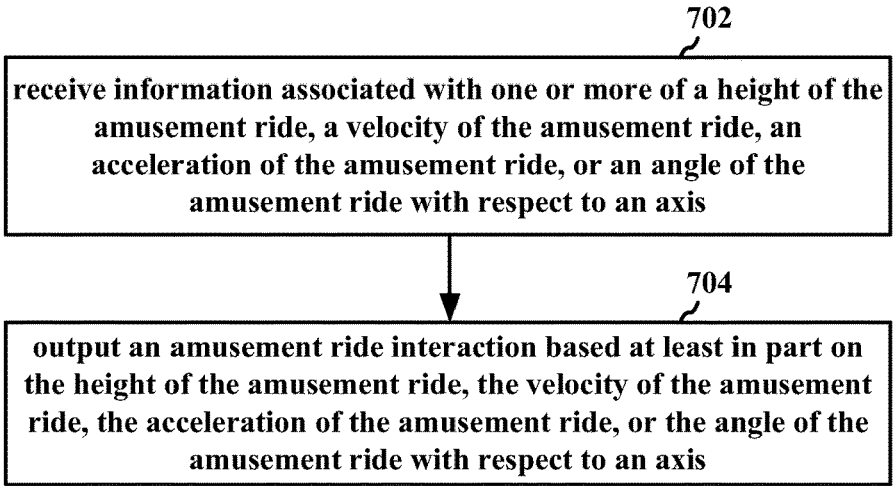
FIG. 7 is a flowchart of a method of operating an amusement ride.

FIG. 7 is a flowchart 700 of a method of operating an amusement ride. The method may be performed by an operating system (e.g., operating system 108, 200, the apparatus 502/502', 802/802').

At 702, the operating system may receive information associated with one or more of a height of the amusement ride, a velocity of the amusement ride, an acceleration of the amusement ride, or an angle of the amusement ride with respect to an axis. In certain aspects, the information may be received from at least one of a gyroscope, an accelerometer, a speedometer, a positioning sensor, a camera, or a proximity sensor. In certain other aspects, the angle may be a vertical angle and the axis is vertical axis. In certain other aspects, the angle may be a horizontal angle and the axis is a horizontal axis. For example, referring to FIG. 1, the operating system 108 may receive (at 101) first information associated with a motion of the amusement ride 102 from the sensing device 106. In certain implementations, the sensing device 106 may obtain information associated with the motion of the amusement ride 102 periodically (e.g., every 1 millisecond, 10 milliseconds, 0.5 seconds, 1 second, 1.5 seconds, 5 seconds, 10 seconds, etc.), and transmit the first information via a wired or wireless connection to the operating system 108 each time the information is obtained or at predetermined intervals (e.g., 5 seconds, 10 seconds, etc.).

At 704, the operating system may output an amusement ride interaction based at least in part on the height of the amusement ride, the velocity of the amusement ride, the acceleration of the amusement ride, or the angle of the amusement ride with respect to the axis. In certain aspects, the amusement ride interaction includes one or more of a water blast, at least one noise emission, at least one light emission, at least one air emission, a change in a height of the amusement ride, a change in a speed of the amusement ride, or a signal sent to one or more mobile devices. For example, referring to FIG. 1, the operating system 108 may output (at 113) the amusement ride interaction based on a height of the amusement ride, a velocity of the amusement ride, an acceleration of the amusement ride, or an angle of the amusement ride with respect to an axis. For example, the operating system 108 may access one or more look-up table(s) that includes a correlation of the motion (e.g., height, acceleration, velocity, vertical angle with respect to a vertical axis, horizontal angle with respect to a horizontal axis, etc.) of the amusement ride 102 to one or more amusement ride interactions (e.g., at least one water output, at least one audio output, at least one light output, at least one air output, a change in a height of the amusement ride, a change in a speed of the amusement ride, a signal sent to one or more mobile devices, or an information output on a display), and output the amusement ride interaction correlated with the motion of the amusement ride 102.

Figure 8:
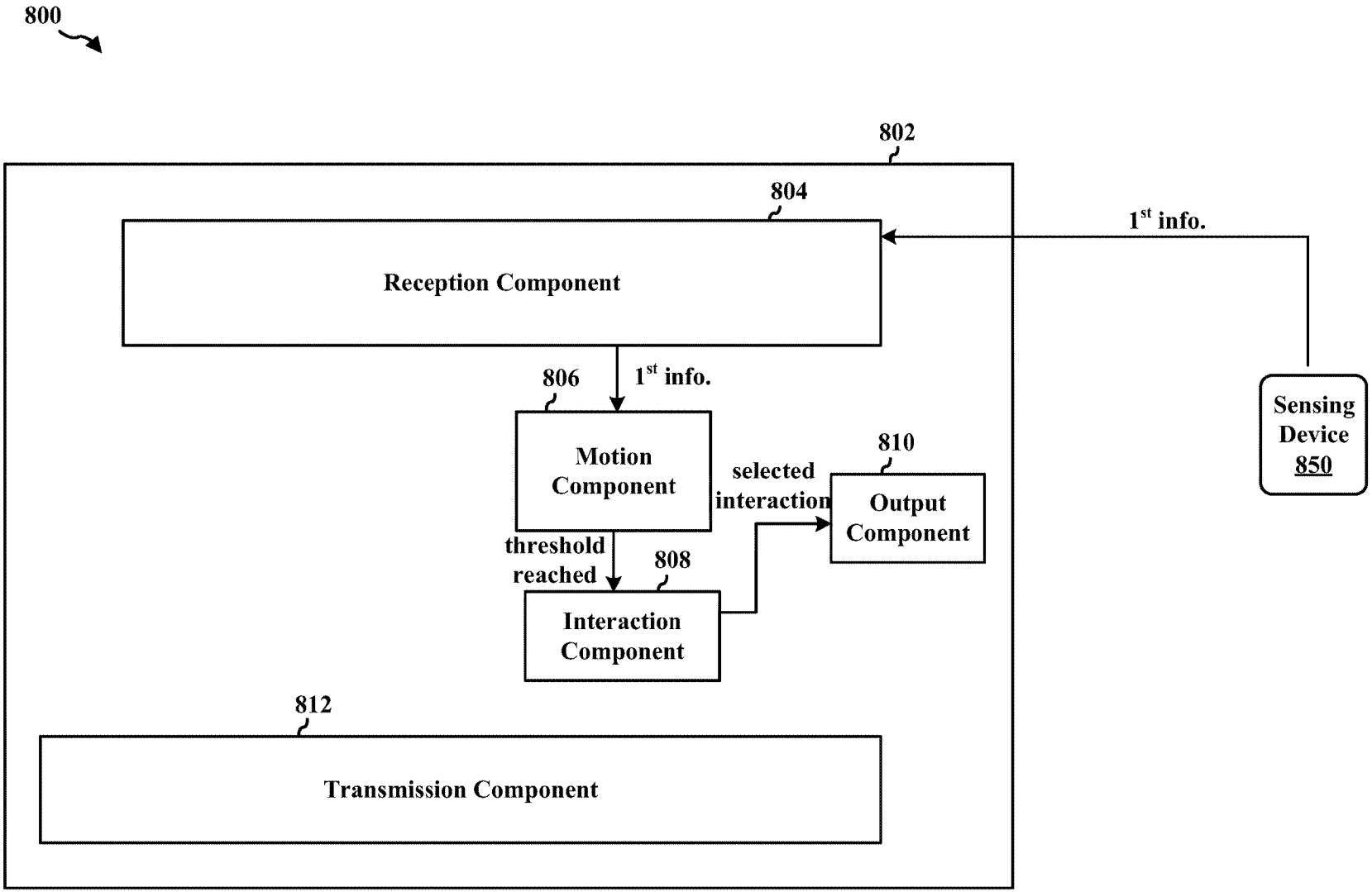
FIG. 8 is a conceptual data flow diagram illustrating the data flow between different means/components in an exemplary apparatus.

FIG. 8 is a conceptual data flow diagram 800 illustrating the data flow between different means/components in an exemplary apparatus 802. The apparatus may be an operating system (e.g., operating system 108, 200, the apparatus 502/502', 802') in communication with at least one sensing device 850 (e.g., the sensing device 106, 550). The apparatus may include a reception component 804, a motion component 806, an interaction component 808, an output component 810, and a transmission component 812.

The reception component 804 may be configured to receive information associated with one or more of a height of the amusement ride, a velocity of the amusement ride, an acceleration of the amusement ride, or an angle of the amusement ride with respect to an axis. In certain aspects, the information may be received from at least one of a gyroscope, an accelerometer, a speedometer, a positioning sensor, a camera, or a proximity sensor. In certain other aspects, the angle may be a vertical angle and the axis is vertical axis. In certain other aspects, the angle may be a horizontal angle and the axis is a horizontal axis. The reception component 804 may be configured to send the information to the motion component 806.

The motion component 806 may be configured to determine whether the motion of the amusement ride meets at least one threshold criterion. In certain aspects, the at least one threshold criterion may include one or more of a threshold height, a threshold velocity, a threshold acceleration, or a threshold angle. Upon determining that the motion of the amusement ride meets the at least one threshold criterion, the motion component 806 may be configured to send a signal indicated the threshold criterion has been met to the interaction component 808.

The interaction component 808 may be configured to select the amusement ride interaction from a plurality of amusement ride interactions. In certain aspects, the selected amusement ride interaction may be correlated with one or more of a height of the amusement ride, a velocity of the amusement ride, an acceleration of the amusement ride, or an angle of the amusement ride with respect to an axis. The interaction component 808 may be configured to send a signal indicating the selected amusement ride interactions to the output component 810.

The output component 810 may be configured to output an amusement ride interaction based at least in part on the height of the amusement ride, the velocity of the amusement ride, the acceleration of the amusement ride, or the angle of the amusement ride with respect to the axis. In certain aspects, the amusement ride interaction includes one or more of a water blast, at least one noise emission, at least one light emission, at least one air emission, a change in a height of the amusement ride, a change in a speed of the amusement ride, or a signal sent to one or more mobile devices. The transmission component 812 may be configured to send signals to one or more devices in an amusement ride system (not illustrated).

The apparatus may include additional components that perform each of the blocks of the algorithm in the aforementioned flowchart of FIG. 7. As such, each block in the aforementioned flowchart of FIG. 7 may be performed by a component and the apparatus may include one or more of those components. The components may be one or more hardware components specifically configured to carry out the stated processes/algorithm, implemented by a processor configured to perform the stated processes/algorithm, stored within a computer-readable medium for implementation by a processor, or some combination thereof.

Figure 9:
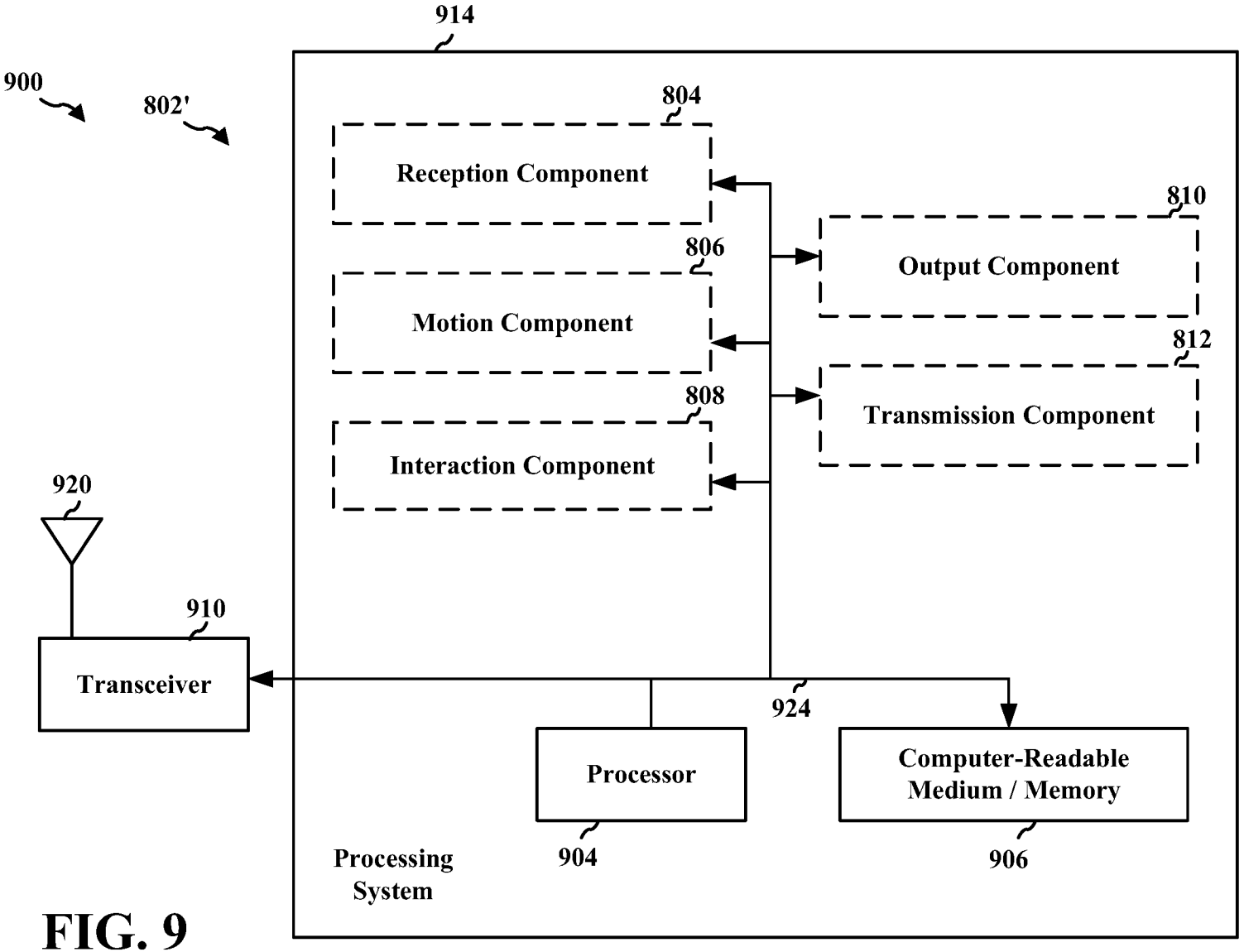
FIG. 9 is a diagram illustrating an example of a hardware implementation for an apparatus employing a processing system.

FIG. 9 is a diagram 900 illustrating an example of a hardware implementation for an apparatus 802' employing a processing system 914. The processing system 914 may be implemented with a bus architecture, represented generally by the bus 924. The bus 924 may include any number of interconnecting buses and bridges depending on the specific application of the processing system 914 and the overall design constraints. The bus 924 links together various circuits including one or more processors and/or hardware components, represented by the processor 904, the components 804, 806, 808, 810, 812, and the computer-readable medium/memory 906. The bus 924 may also link various other circuits such as timing sources, peripherals, voltage regulators, and power management circuits, which are well known in the art, and therefore, will not be described any further.

The processing system 914 may be coupled to a transceiver 910. The transceiver 910 is coupled to one or more antennas 920. The transceiver 910 provides a means for communicating with various other apparatus over a transmission medium. The transceiver 910 receives a signal from the one or more antennas 920, extracts information from the received signal, and provides the extracted information to the processing system 914, specifically the reception component 804. In addition, the transceiver 910 receives information from the processing system 914, specifically the transmission component 812, and based on the received information, generates a signal to be applied to the one or more antennas 920. The processing system 914 includes a processor 904 coupled to a computer-readable medium/memory 906. The processor 904 is responsible for general processing, including the execution of software stored on the computer-readable medium/memory 906. The software, when executed by the processor 904, causes the processing system 914 to perform the various functions described supra for any particular apparatus. The computer-readable medium/memory 906 may also be used for storing data that is manipulated by the processor 904 when executing software. The processing system 914 further includes at least one of the components 804, 806, 808, 810, 812. The components may be software components running in the processor 904, resident/stored in the computer readable medium/memory 906, one or more hardware components coupled to the processor 904, or some combination thereof.

In certain configurations, the apparatus 802/802' for operation of an amusement ride may include means for receiving information associated with one or more of a height of the amusement ride, a velocity of the amusement ride, an acceleration of the amusement ride, or an angle of the amusement ride with respect to an axis. In certain aspects, the information may be received from at least one of a gyroscope, an accelerometer, a speedometer, a positioning sensor, a camera, or a proximity sensor. In certain other aspects, the angle may be a vertical angle and the axis is vertical axis. In certain other aspects, the angle may be a horizontal angle and the axis is a horizontal axis. In certain configurations, the apparatus 802/802' for operation of an amusement ride may include means for outputting an amusement ride interaction based at least in part on the height of the amusement ride, the velocity of the amusement ride, the acceleration of the amusement ride, or the angle of the amusement ride with respect to the axis. In certain aspects, the amusement ride interaction includes one or more of a water blast, at least one noise emission, at least one light emission, at least one air emission, a change in a height of the amusement ride, a change in a speed of the amusement ride, or a signal sent to one or more mobile devices. The aforementioned means may be one or more of the aforementioned components of the apparatus 802 and/or the processing system 914 of the apparatus 802' configured to perform the functions recited by the aforementioned means.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

APPLICANT'S STATEMENT

In compliance with 37 CFR 1.125(b), Applicant submits that this substitute specification contains no new matter.

What is claimed is:

1. A method of operating an amusement ride, comprising:

receiving first information associated with a motion of the amusement ride;

determining whether the motion of the amusement ride meets at least one threshold criterion;

receiving second information indicating at least one of a set of objects or a set of user characteristics upon determining that the motion of the amusement ride meets the at least one threshold criterion, wherein the at least one of the set of objects or the set of user characteristics is determined by recognizing features or landmarks of objects in an image of a segment of the ride by extracting landmarks, features, movements or positions from known landmarks or features of similar objects; and outputting an amusement ride interaction based at least in part on the at least one of the set of objects or the set of user characteristics indicated by the second information.

2. The method of claim 1, wherein the motion of the amusement ride includes one or more of a position of the amusement ride, a velocity of the amusement ride, an acceleration of the amusement ride, or an angle of the amusement ride with respect to an axis.

3. The method of claim 1, wherein the first information is received from at least one of a gyroscope, an accelerometer, a speedometer, a positioning sensor, a camera, or a proximity sensor.

4. The method of claim 1, wherein the at least one threshold criterion includes one or more of a threshold height, a threshold velocity, a threshold acceleration, or a threshold angle.

5. The method of claim 1, wherein the amusement ride interaction includes one or more of at least one water output, at least one audio output, at least one light output, at least one air output, a change in a height of the amusement ride, a change in a speed of the amusement ride, a signal sent to one or more mobile devices, or an information output on a display.

6. The method of claim 1, wherein the set of user characteristics includes one or more of a ratio of a number of gestures to a number of riders in a segment of the amusement ride, a noise level output by the riders, or a gesture performed by the riders.

7. The method of claim 1, further comprising:

sending a signal to at least one image device associated with the amusement ride upon determining that the motion of the amusement ride meets the at least one threshold criterion, the signal instructing the at least one image device to obtain the second information.

8. The method of claim 7, wherein the at least one threshold criterion includes an initial motion of the amusement ride or receiving user instructions to initiate the amusement ride interaction.

9. The method of claim 1, further comprising:

selecting the amusement ride interaction from a plurality of amusement ride interactions, the selected amusement ride interaction being correlated with the set of objects or the set of user characteristics.

10. The method of claim 9, further comprising:

receiving third information indicating at least one user reaction to the amusement ride interaction based on at least one of a set of objects or a set of user characteristics, wherein the at least one of the set of objects or the set of user characteristics is determined by recognizing features or landmarks of objects in an image of a segment of the ride by extracting landmarks, features, movements or positions from known landmarks or features of similar objects; and updating a correlation between the at least one of the set of objects or the set of user characteristics and the amusement ride interaction based at least in part on the third information.

11. The method of claim 10, wherein the at least one user reaction includes one or more of a gesture, or a noise level output.

12. The method of claim 10, wherein the updating the correlation between the at least one user reaction and the amusement ride interaction based at least in part on the third information comprises:

correlating the at least one user reaction with a different amusement ride interaction.

13. The method of claim 1, further comprising:

determining an amusement ride cycle from a plurality of amusement ride cycles, wherein the outputting the amusement ride interaction based at least in part on the at least one of the set of objects or the set of user characteristics indicated by the second information further comprises:

outputting the amusement ride interaction based on the amusement ride cycle.

14. A method of operating an amusement ride, comprising:

receiving information associated with one or more of a height of the amusement ride, a velocity of the amusement ride, an acceleration of the amusement ride, or an angle of the amusement ride with respect to an axis;

outputting a first amusement ride interaction based at least in part on the at least one of the height of the amusement ride, the velocity of the amusement ride, the acceleration of the amusement ride, or the angle of the amusement ride with respect to the axis; and changing the first amusement ride interaction to a second amusement ride interaction different from the first amusement ride interaction, based on at least one user reaction to the first amusement ride interaction, wherein the at least one user reaction is determined based on at least one of a set of objects or a set of user characteristics, wherein the at least one of the set of objects or the set of user characteristics is determined by recognizing features or landmarks of objects in an image of a segment of the ride by extracting landmarks, features, movements or positions from known landmarks or features of similar objects.

15. The method of claim 14, wherein the information is received from at least one of a gyroscope, an accelerometer, a speedometer, a positioning sensor, a camera, or a proximity sensor.

16. The method of claim 14, wherein the first and second amusement ride interactions are independently one or more of a water blast, at least one noise emission, at least one light emission, at least one air emission, a change in a height of the amusement ride, a change in a speed of the amusement ride, or a signal sent to one or more mobile devices.

17. The method of claim 14, wherein: the angle is a vertical angle and the axis is vertical axis, or the angle is a horizontal angle and the axis is a horizontal axis.

18. The method of claim 14, wherein the at least one user reaction includes one or more of a gesture or a noise level output.

19. An apparatus for operating an amusement ride, comprising:

a memory; and at least one processor coupled to the memory, the processor being configured to:

receive first information associated with a motion of the amusement ride;

determine whether the motion of the amusement ride meets at least one threshold criterion;

receive second information indicating at least one of a set of objects or a set of user characteristics upon determining that the motion of the amusement ride meets the at least one threshold criterion, wherein the at least one of the set of objects or the set of user characteristics is determined by recognizing features or landmarks of objects in an image of a segment of the ride by extracting landmarks, features, movements or positions from known landmarks or features of similar objects; and output an amusement ride interaction based at least in part on the at least one of the set of objects or the set of user characteristics indicated by the second information.

20. The apparatus of claim 19, wherein the motion of the amusement ride includes one or more of a position of the amusement ride, a velocity of the amusement ride, an acceleration of the amusement ride, or an angle of the amusement ride with respect to an axis.

21. The apparatus of claim 19, wherein the first information is received from at least one of a gyroscope, an accelerometer, a speedometer, a positioning sensor, a camera, or a proximity sensor.

22. The apparatus of claim 19, wherein the at least one threshold criterion includes one or more of a threshold height, a threshold velocity, a threshold acceleration, or a threshold angle.

23. The apparatus of claim 19, wherein the amusement ride interaction includes one or more of at least one water output, at least one audio output, at least one light output, at least one air output, a change in a height of the amusement ride, a change in a speed of the amusement ride, a signal sent to one or more mobile devices, or an information output on a display.

24. The apparatus of claim 19, wherein the set of objects includes one or more of a number of gestures, a number of riders, or a number of riders in a segment of the amusement ride and the set of user characteristics includes one or more of a ratio of a number of gestures to a number of riders in a segment of the amusement ride, a noise level output by the riders, or a gesture performed by the riders.

25. The apparatus of claim 19, wherein the at least one processor is further configured to:

send a signal to at least one image device associated with the amusement ride upon determining that the motion of the amusement ride meets the at least one threshold criterion, the signal instructing the at least one image device to obtain the second information.

26. The apparatus of claim 25, wherein the at least one threshold criterion includes an initial motion of the amusement ride or receiving user instructions to initiate the amusement ride interaction.

27. The apparatus of claim 19, wherein the at least one processor is further configured to:

select the amusement ride interaction from a plurality of amusement ride interactions, the selected amusement ride interaction being correlated with the set of objects or the set of user characteristics.

28. The apparatus of claim 27, wherein the at least one processor is further configured to:

receive third information indicating at least one user reaction to the amusement ride interaction based on at least one of a set of objects or a set of user characteristics, wherein the at least one of the set of objects or the set of user characteristics is determined by recognizing features or landmarks of objects in an image of a segment of the ride by extracting landmarks, features, movements or positions from known landmarks or features of similar objects; and update a correlation between the at least one of the set of objects or the set of user characteristics and the amusement ride interaction based at least in part on the third information.

29. The apparatus of claim 28, wherein the at least one user reaction includes one or more of a gesture, or a noise level output.

30. The apparatus of claim 28, wherein the at least one processor is configured to update the correlation between the at least one user reaction and the amusement ride interaction based at least in part on the third information by:

correlating the at least one user reaction with a different amusement ride interaction.

31. The apparatus of claim 19, wherein the at least one processor is further configured to:

determine an amusement ride cycle from a plurality of amusement ride cycles, wherein the at least one processor is configured to output the amusement ride interaction based at least in part on the at least one of the set of objects or the set of user characteristics indicated by the second information and further based on the amusement ride cycle.

32. An apparatus for operating an amusement ride, comprising:

a memory; and at least one processor coupled to the memory and configured to:

receive information associated with one or more of a height of the amusement ride, a velocity of the amusement ride, an acceleration of the amusement ride, or an angle of the amusement ride with respect to an axis;

output a first amusement ride interaction based at least in part on the at least one of the height of the amusement ride, the velocity of the amusement ride, the acceleration of the amusement ride, or the angle of the amusement ride with respect to the axis; and change the first amusement ride interaction to a second amusement ride interaction different from the first amusement ride interaction, based on at least one user reaction to the first amusement ride interaction, wherein the at least one user reaction is determined based on at least one of a set of objects or a set of user characteristics, wherein the at least one of the set of objects or the set of user characteristics is determined by recognizing features or landmarks of objects in an image of a segment of the ride by extracting landmarks, features, movements or positions from known landmarks or features of similar objects.

33. The apparatus of claim 32, wherein the information is received from at least one of a gyroscope, an accelerometer, a speedometer, a positioning sensor, a camera, or a proximity sensor.

34. The apparatus of claim 32, wherein the amusement ride interaction includes one or more of a water blast, at least one noise emission, at least one light emission, at least one air emission, a change in a height of the amusement ride, a change in a speed of the amusement ride, or a signal sent to one or more mobile devices.

35. The apparatus of claim 32, wherein:

the angle is a vertical angle and the axis is vertical axis, or the angle is a horizontal angle and the axis is a horizontal axis.

36. The apparatus of claim 32, wherein the at least one user reaction includes one or more of a gesture or a noise level output.

* * * * *